United States Patent [19]

King

[11] 4,407,636

[45] Oct. 4, 1983

[54] SELF-CLEANING SUBMERSIBLE PUMP

[75] Inventor: Nigel D. King, Southampton, England

[73] Assignee: Exxon Research and Engineering Co., Florham Park, N.J.

[21] Appl. No.: 325,972

[22] Filed: Nov. 30, 1981

Related U.S. Application Data

[63] Continuation of Ser. No. 99,664, Dec. 3, 1979, abandoned, which is a continuation of Ser. No. 868,055, Jan. 9, 1978, abandoned.

[30] Foreign Application Priority Data

Jan. 10, 1977 [GB] United Kingdom ..... 719/77

[51] Int. Cl.³ ..... F04F 1/10; F04F 7/00

[52] U.S. Cl. ..... 417/118; 417/240

[58] Field of Search ..... 417/108, 118, 240, 241

[56] References Cited

U.S. PATENT DOCUMENTS

| | | | |
|---|---|---|---|
| 32,030 | 4/1861 | Martin | 417/118 |
| 129,353 | 7/1872 | Lytle | 417/118 |
| 2,953,095 | 9/1960 | Bodine | 417/241 |
| 3,991,825 | 11/1976 | Morgan | 417/118 X |

FOREIGN PATENT DOCUMENTS

| | | | |
|---|---|---|---|
| 1157507 | 12/1957 | France | 417/241 |

*Primary Examiner*—Richard E. Gluck

*Attorney, Agent, or Firm*—Donald F. Wohlers

[57] ABSTRACT

A pump for pumping liquids which may contain solid debris, comprising a conduit having an orifice at its lowest region for the ingress of liquid when the lowest region is submerged in the liquid, one end of the conduit being connected to a sources of pulses of propellant fluid (e.g. air) and the other end being adapted to deliver slugs of liquid to a receiving vessel. The conduit may be U-shaped with the orifice at the bottom, or it may comprise one conduit portion within and open to another conduit portion having the orifice at the bottom thereof.

1 Claim, 4 Drawing Figures

15
20
21
14
16
17
10
11
11
19
19
18
18
13
12

SELF-CLEANING SUBMERSIBLE PUMP

This is a continuation, of application Ser. No. 99,664, filed Dec. 3, 1979, now abandoned, which was a continuation of application Ser. No. 868,055 filed Jan. 9, 1978, now abandoned.

The present invention relates to pumps for pumping liquids and other flowable materials.

In this disclosure the term "liquids" comprehends not only liquids but also other flowable materials such as slurries.

Difficulties are sometimes encountered when conventional pumps are employed to pump liquids containing solid or semi-solid substances of such sizes that they tend to obstruct the orifice into, and conduits through, the pump.

In addition, it is sometimes desirable or essential to locate the pump-driving mechanism at a remote location from the liquid in order to avoid hazards arising from the flammability of the liquid.

The present invention provides a pump for pumping liquids, (line 12) comprising the combination of a downcomer conduit portion, a riser conduit portion communicable or communicating with one end of the downcomer portion at, or in the region of, the lowest part thereof for the passage of a propellant fluid from the other end of the downcomer conduit portion to the other end of the riser conduit portion. An open orifice is provided in the lowest region of one of the conduit portions for the entry of liquid from outside when the orifice is submerged in the liquid propellant fluid is passed intermittently into other end of the downcomer conduit portion whereby when the orifice is submerged in liquid, some liquid is propelled up the riser portion to the said other end thereof and some liquid is propelled out of the orifice thereby rendering the orifice at least temporarily free of any orifice-obstructing material outside the conduit portion.

The downcomer portion and riser portion may form a conduit having the general configuration of a 'U', the said orifice being defined in the lowest region of the 'U'.

The open orifice is preferably, but not essentially, on or towards the underside or invert of the U, rather than on the upper side or soffit.

Alternatively, one conduit portion may be at least partially within the other conduit portion, the bottom of the said other conduit portion defining said orifice and the bottom of said one conduit portion being open within the other conduit portion and spaced a relatively short distance above the bottom. Preferably means are provided for securing the conduit portions relative to each other.

One or both of the conduit portion(s) may be formed from a plurality of discrete conduit lengths of which adjacent lengths are preferably detachably attachable or detachably secured to each other in a substantially fluid tight manner, to avoid or mitigate leakage as far as possible.

For use, at least the part of the conduit having the orifice therein is submerged in a substance containing the liquid or other flowable material.

The orifice must be of sufficient size to permit the ingress of liquid or other flowable material between successive pulses of the propellant fluid, but not so large that substantially all of the propellant fluid of each pulse escapes out of the conduit. The orifice may be relatively small so that only a small proportion of the propellant fluid or liquid at each pulse escapes out of the conduit, whereby any components of the substance tending to block or partially block the orifice are, at least temporarily, cleared away by escaping propellant fluid and/or liquid.

The orifice may have any convenient or suitable shape—e.g. a slot or circular aperture. Preferably, the diameter or largest dimension of the orifice should be smaller than the internal diameter or largest internal dimension of the conduit.

The propellant fluid may be of any type suitable for obtaining the discharged liquid or other flowable material in a desired quality, i.e., if the discharged liquid is to be a substantially chemically and physically unchanged sample of the liquid contained in the substance in which the orificed part of the conduit is immersed, the propelling fluid is preferably substantially inert with respect to the liquid.

The means for passing the propellant fluid into the said one end of the tube in pulses may comprise, e.g. an intermittently operated pump and/or an intermittently operated valve which provides and interrupts communication between a source of propellant fluid and the said one end of the conduit.

Suitable means may be provided for venting propellant fluid from the conduit between successive pulses of propellant fluid to facilitate the ingress of liquid or other flowable material into the conduit. Such means may conveniently be a port in, or associated with, the said valve and/or pump.

The invention further provides a pump comprising a plurality of downcomer conduit portions each associated with a respective riser conduit portion and a single means operable for passing propellant fluid intermittently into each downcomer conduit portion.

The invention is now further described with reference to some non-limitative embodiments thereof and with reference to the accompanying drawings in which.

Figure 1:
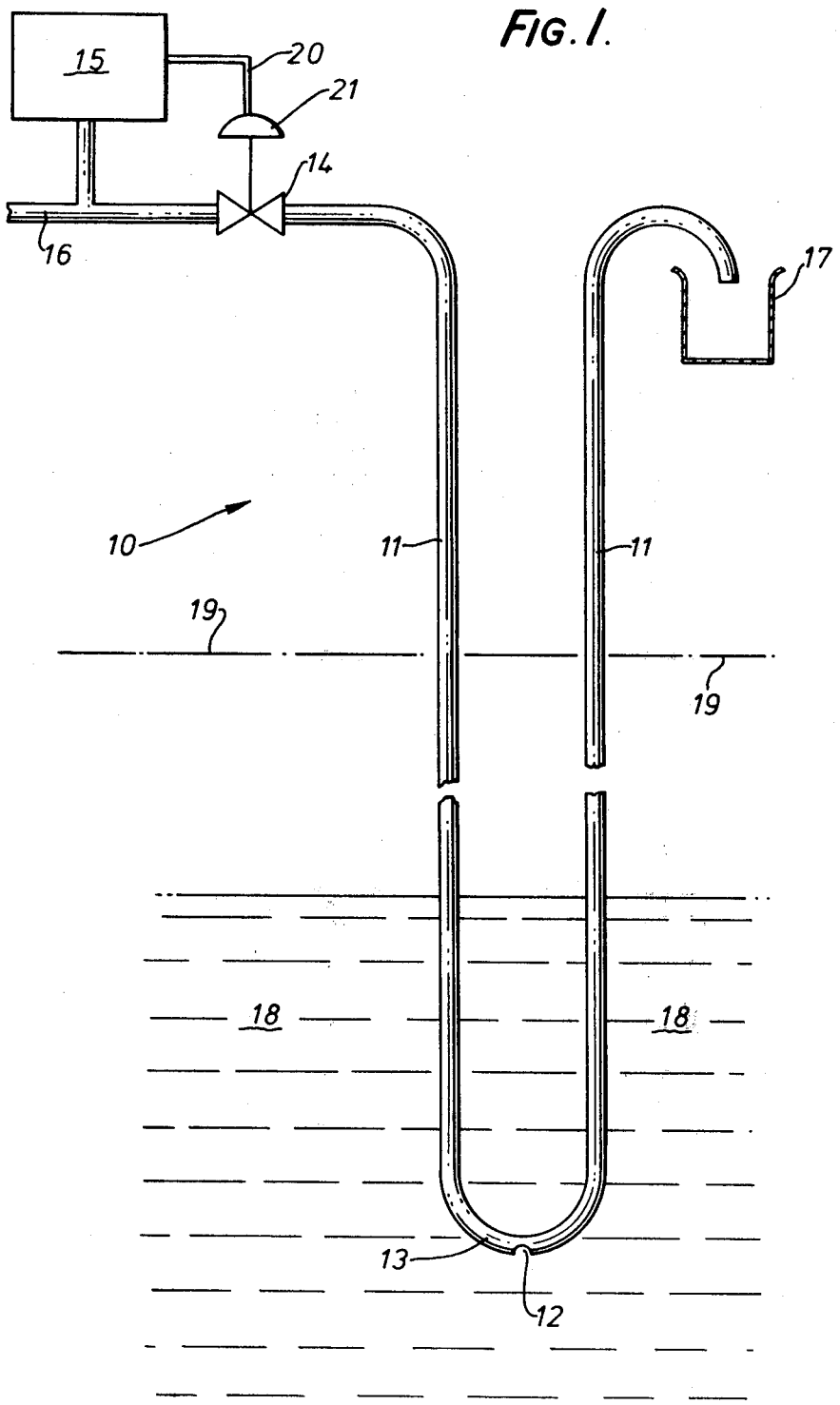
FIG. 1 is a diagrammatic side elevation of a pump for sampling liquid.

Referring first to FIG. 1, the pump 10 is seen to comprise a U-shaped conduit 11 having a circular hole 12 at the invert 13 of the bottom bend of the U. One end of the conduit 11 is connected to a three-way valve 14 which is intermittently operated by a pneumatically driven timing device 15.

The valve 14, and the timing device 15, are connected to a pipe 16 supplied with filtered air at, e.g. 30 psi, or any other suitable and convenient pressure. The other end of the conduit is open to discharge pumped liquid to a receiving container 17.

For operation of the pump 10, the conduit 11 is lowered into the liquid-containing substance 18, which may be sewerage containing solid debris, the surface of the sewerage 18 being at some distance (e.g. 20 feet) below ground level 19.

Compressed air is supplied to pipe 16, and some passes to the timing device 15 where it drives a pneumatic motor (not shown) which periodically passes air via line 20 to a diaphragm 21 of valve 14 so that valve 14 opens and permits compressed air to pass into conduit 11. The compressed air drives a slug of liquid down the left-hand (as illustrated) arm of conduit 11 and up the right hand arm, the liquid being discharged to the container 17. Some of the liquid and some of the air will pass out of the conduit 11 via the hole 12. The outward passage of the liquid and air clears debris away from the hole 12.

When the supply of compressed air is cut off, the left-hand arm of conduit 11 is vented to atmosphere via a port (not shown) in valve 14, and further quantities of liquid may then enter the conduit 11 via the hole 12 without any substantial obstruction.

The timing device 15, after a predetermined interval of time, releases the compressed air in line 20 to atmosphere, and the valve 14 then returns to its closed position thereby interrupting the supply of compressed air to the conduit 11. As the pressure in the conduit 11 falls, liquid enters via the unobstructed hole 12, and may be subsequently discharged to the container 17 in the next part of the cycle of the pump 10.

It will be appreciated that the pump 10 is self-cleaning in that blockages of the hole 12 are cleared when air is passed into conduit 11, the pump avoids the use of expensive equipment, and enables one to obtain either single samples or aggregated samples of liquid from a selected depth of the sewerage 18.

In a practical embodiment, the conduit 11 was of pipe having an outer diameter of about 0.25 inch and an inner diameter of 3/16 inch, and the hole 12 was about ⅛ inch diameter, and submerged up to 4 feet deep in turbulent sewerage. Compressed, filtered air was supplied at 30 psig, and the timing device 15 was arranged to open the valve 14 once every 10–15 minutes for 5 to 10 seconds. The liquid recovered in container 17 amounted to about 1 liter/day of a composite sample.

Figure 2:
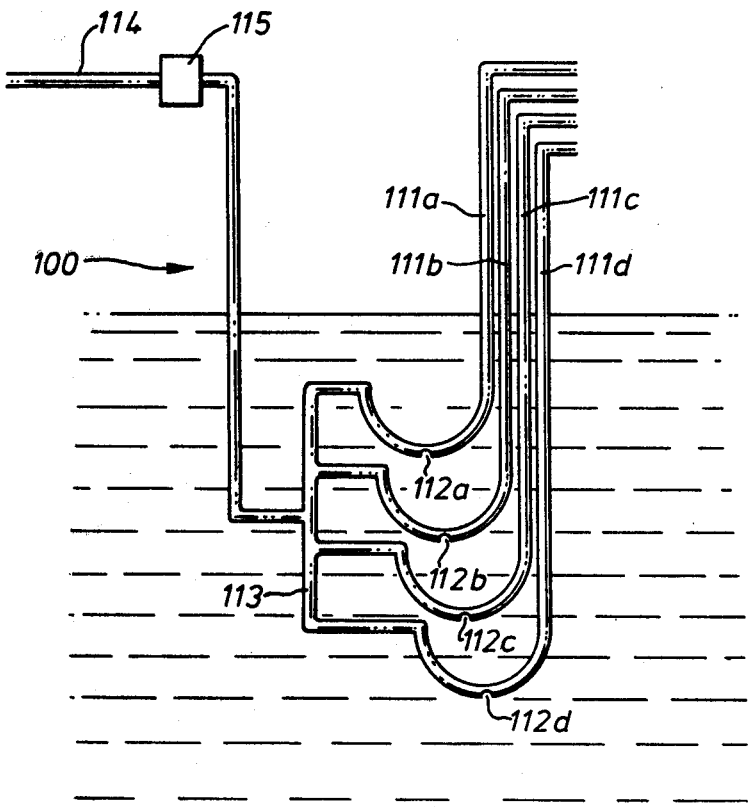
FIG. 2 is a diagrammatic side elevation of a pump for obtaining samples of liquid from different depths in a liquid-containing substance.

In the pump 100 of FIG. 2, there are four 'U'-conduits 111*a*, 111*b*, 111*c* and 111*d* each having a hole 112*a*, 112*b*, 112*c* and 112*d* at the bend of the U. The conduits 111 discharge either to a single or respective vessel (not shown) at their right hand upper ends (as illustrated), and are connected at their left-hand ends to a common manifold 113 which receives compressed air, preferably at a relatively higher pressure than in the FIG. 1 embodiment, e.g. 80 psig, from an air line 114 when an intermittently opened valve 115 is opened. Alternatively, or in addition, a relatively lower air pressure (e.g. 30 psig) may be employed, and the U-conduits 111 may be so formed that the upper conduits offer a higher flow resistance than the lower conduits to ensure that an adequate air pulse passes to the lowest conduit 111*d* which is subjected to the greatest hydrostatic pressure due to its relatively deep immersion in liquid. As a variant, the manifold 113 may provide progressively increased flow resistance towards the top conduit 111*a* for the same purpose.

The valve and the arrangement for operating it for supplying air to, and for venting, conduits 111 at predetermined times may be the same as described with reference to FIG. 1, or it may be operated manually, electrically, hydraulically or by clockwork (as indeed may the valve 14 of FIG. 1).

The passage of a pulse of compressed air through the conduits 111 passes slugs of liquid to the receiving vessel(s) (not shown) and, at the same time, clears the holes 112 to permit the subsequent entry of further quantities of liquid when the air pulse has finished and the pressure in the conduits 111 adequately fallen.

Figure 3:
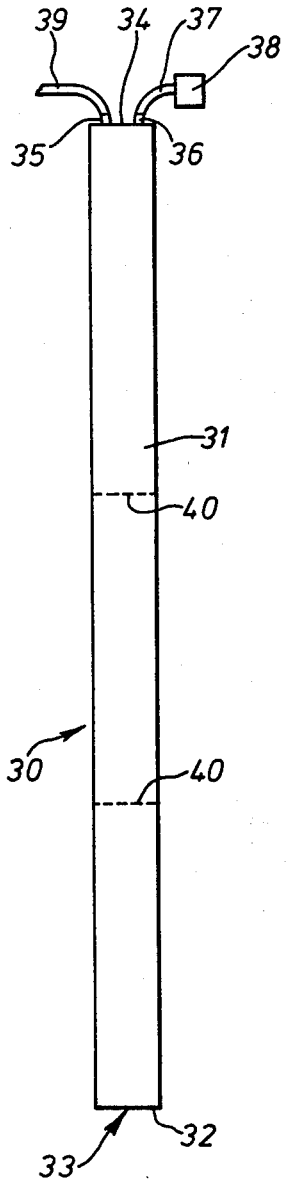
FIG. 3 is a diagrammatic side elevation of part of another pump.
Figure 4:
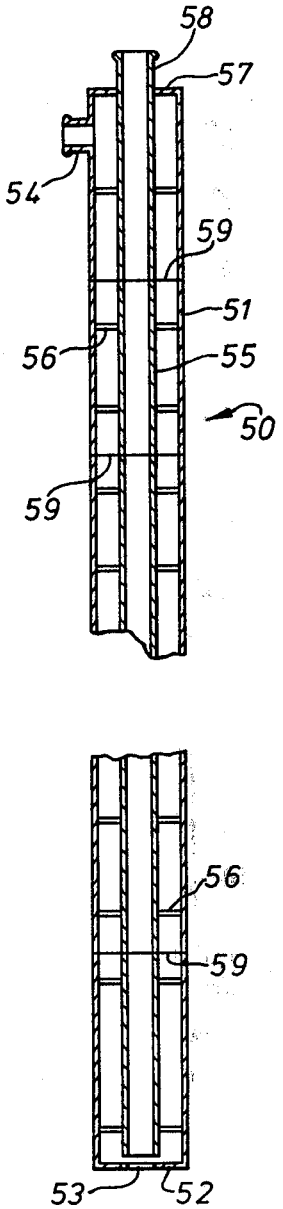
FIG. 4 is a diagrammatic vertical cross-section, to a larger scale, through a pump similar to that depicted in FIG. 3.

Reference is now made to FIGS. 3 and 4 which show embodiments of the pump wherein, in effect, one arm of the conduit of FIG. 1 is within the other arm.

In FIG. 3, the pump (generally indicated by reference 30) comprises a relatively elongated cylinder 31 which is closed at the bottom by a circular plate 32 (not visible) having an orifice (not visible) therethrough, the orifice being indicated by reference 33. The top of the cylinder is closed by a circular plate 34 from which protrude two short tube 35, 36. Tube 36 is connected by a suitable conduit 37 to an air pump 38 which is operable to deliver pressurized air intermittently (e.g. as described with reference to FIGS. 1 and 2) to the interior of the cylinder via conduit 37 and tube 36.

When the cylinder 31 is so disposed that the orifice 33 is submerged in liquid, liquid enters the cylinder 31 via the orifice 33 when no pressurized air is delivered by the pump 38. However, when pressurized air is delivered by the pump 38, at least some air propels liquid up an interior conduit (not visible in FIG. 3) of the cylinder to the tube 35, and the thus propelled liquid may be recovered or collected from the free end of a conduit 39 attached to the conduit 35. Any materials tending to block the orifice 33 are at least temporarily displaced from the orifice by the discharge of some liquid and possibly some air from within the cylinder 31 via the orifice 33.

For portability, the cylinder 31 (and its non-visible internal conduit portions) may be comprised of a plurality of disconnectable lengths which are connected at join lines 40, and the conduits 37, 39 and the air pump 38 may also be disconnectible from the cylinder 31 and from each other.

The air pump may be operated mechanically, pneumatically, electrically, hydraulically, or it may be operated manually. When the amount of air required for operation of the pump is small, the air pump may be merely a hollow rubber or plastics bulb having a suitable one-way valve for the entry of air.

FIG. 4 shows one manner of arranging the interior of the cylinder of the pump of FIG. 3, but with some minor modifications (relative to FIG. 3) appertaining to the positions of the pressurized air input conduit and the liquid recovery conduit.

In FIG. 4 the pump, generally indicated by reference 50, comprises two tubes, which are preferably, but not essentially, substantially coaxial. The external tube 51 has a bottom closure plate 52 with an orifice 53 therethrough and a liquid discharge tube 54 radially disposed near the top of tube 51. The interior tube 55 is supported within the exterior tube 51 by suitable means such as radial spokes or spiders 56, and the bottom of the interior tube 55 is separated from the bottom closure plate 52 by a relatively short distance. The orifice 53 may or may not be coaxial with the interior tube 55. The top of the exterior tube 51 is closed by an annular plate 57 and the interior tube 55 extends upwardly through the plate in a substantially fluid-tight manner, the upwardly projecting portion 58 serving for connection to an air pump or other source (not shown) which is operable to supply pressurized air intermittently. Alternatively, the radial tube 54 may be employed for connection to the air pump and the tube portion 58 for the discharge of liquid. The relative sizes and positions of the exterior and interior tubes 51, 55, and the orifice 53, and the air pump (not shown) may be determined experimentally without difficulty for a particular use of the pump.

When the tubes 51, 55 are relatively long, it may be convenient to form them from separable lengths, as indicated by the joint lines 59. The joints between adjacent lengths may be of any convenient type provided that fluid leakages between the interior and exterior tubes are within acceptable limits during use, and provided also that there is substantially no leakage from inside the exterior tube 51 to the outside, and that the lengths of tube are not separated when pressurized air is passed through them. In some instances, it may be adequate to join the tube lengths by so-call "push-fits" which rely on friction to maintain the joint, but when the pressures involved may be relatively high, adjacent tube lengths may be more strongly secured to each other—e.g. by bayonet-type fittings or threaded joints, optionally with gaskets between adjacent lengths. All of the foregoing modes of attachment, and many others not referred to, are well-known in the art and are therefore not described.

A plurality of the downcomer/riser conduit portions 30, 50 of the type described with reference to FIGS. 3 and 4 may be connected to a single source of pressurized air pulses, in a manner similar to that described in relation to the embodiment of FIG. 2.

It will be appreciated that some or all of the conduit of FIGS. 1 and 2 may be formed from discrete conduit lengths of which adjacent lengths are detachably secured to each other in a suitably fluid tight fashion.

What we claim is:

1. A self-cleaning pump for simultaneously and intermittently pumping a plurality of relatively small liquid samples from different levels of a body of liquid, such as sewage containing solid particles, comprising, in combination, supply means for providing a propellant gas, an unobstructed plurality of downcomer conduit portions connected through a single conduit to said supply means, each downcomer conduit portion operably associated with a respective unobstructed riser conduit portion, and each riser conduit portion in communication at one end with one end of each downcomer conduit portion substantially at the lowest region thereof for the passage of a propellant gas from the other end of the respective downcomer conduit portion to the other end of the respective riser conduit portion, each of said downcomer conduit portions and said riser conduit portions arranged to be fixedly submerged at least partially in said liquid, respective ones of said riser conduit and downcomer portions being disposed at different levels within said liquid in which said plurality are submerged, an unobstructed inlet orifice located in the lowest region of each one of the respective conduit portions for the entry of liquid thereinto from said body of liquid when each orifice is submerged in the liquid, each said orifice being sized to permit the inlet of liquid into each said riser conduit portion and each said downcomer conduit portion to a level equal to the level of liquid in said body of liquid and to block entry of solid particles of greater size than said orifice between successive pulses of a propellant gas, said supply means being intermittently activated to pass a propellant gas through said single conduit into each other end of the respective downcomer conduit portions to clear solid particles in said liquid away from said orifices and simultaneously propel liquid from each said downcomer conduit portion to said other end of each respective raiser conduit portion, whereby some liquid and propellant gas are propelled out of said conduit portions through each said orifice during operation of said pump for at least temporarily freeing each said orifice of any orifice-obstructing solid particles.

* * * * *